US006201942B1

(12) United States Patent
Honda et al.

(10) Patent No.: US 6,201,942 B1
(45) Date of Patent: Mar. 13, 2001

(54) DEVELOPER-CARRYING MEMBER, AND DEVELOPING DEVICE AND IMAGE FORMING APPARATUS INCLUDING THE MEMBER

(75) Inventors: Takao Honda, Mishima; Nobuaki Hara, Numazu; Hatsuo Tajima; Tsuyoshi Watanabe, both of Mishima; Keitaro Yamashita, Saitama-ken; Hiromi Kashiwagi, Fukaya, all of (JP)

(73) Assignees: Canon Kabushiki Kaisha; Hitachi Metal, Ltd., both of Tokyo (JP)

( * ) Notice: Subject to any disclaimer, the term of this patent is extended or adjusted under 35 U.S.C. 154(b) by 0 days.

(21) Appl. No.: 09/537,876

(22) Filed: Mar. 29, 2000

(30) Foreign Application Priority Data

Mar. 31, 1999 (JP) ..... 11-090814

(51) Int. Cl.[7] ..... G03G 15/08
(52) U.S. Cl. ..... 399/286
(58) Field of Search ..... 399/286, 279, 399/264; 492/53, 54

(56) References Cited

U.S. PATENT DOCUMENTS

| | | | | |
|---|---|---|---|---|
| 4,368,971 | | 1/1983 | Watanabe et al. . | |
| 4,380,966 | | 4/1983 | Isaka et al. . | |
| 4,564,285 | * | 1/1986 | Yasuda et al. | 399/286 X |
| 4,866,480 | * | 9/1989 | Hosoya et al. . | |
| 4,870,461 | | 9/1989 | Watanabe et al. . | |
| 5,563,690 | * | 10/1996 | Hasegawa et al. | 399/286 |
| 5,697,027 | * | 12/1997 | Takagi et al. | 399/279 |

FOREIGN PATENT DOCUMENTS

| | | |
|---|---|---|
| 54-79043 | 6/1979 | (JP) . |
| 55-026526 | 2/1980 | (JP) . |
| 58-132768 | 8/1983 | (JP) . |
| 6-230676 | 8/1994 | (JP) . |

* cited by examiner

*Primary Examiner*—Susan S. Y. Lee
(74) *Attorney, Agent, or Firm*—Fitzpatrick, Cella, Harper & Scinto

(57) ABSTRACT

A developer-carrying member to be installed in an electrophotographic developing device for carrying and conveying a developer along a surface thereof, is formed of a substrate, and an intermediate electroless plating layer and an electroplating layer disposed in this order on the substrate. As a result of the electroless and electro double plating layer structure, the developer-carrying member is provided with a wear-resistant surface which has an appropriate degree of roughness suitable for conveying the developer thereon and is yet free from minute projections and cracks undesirable from the viewpoint of continuous image forming performances.

26 Claims, 4 Drawing Sheets

$$\Delta a = \frac{1}{\ell}\int_0^{\ell}\left|\frac{dy}{dx}\right|dx = \left(\frac{h_1 + h_2 + h_3 + \cdots + h_n}{\ell}\right)$$

FIG. 7A
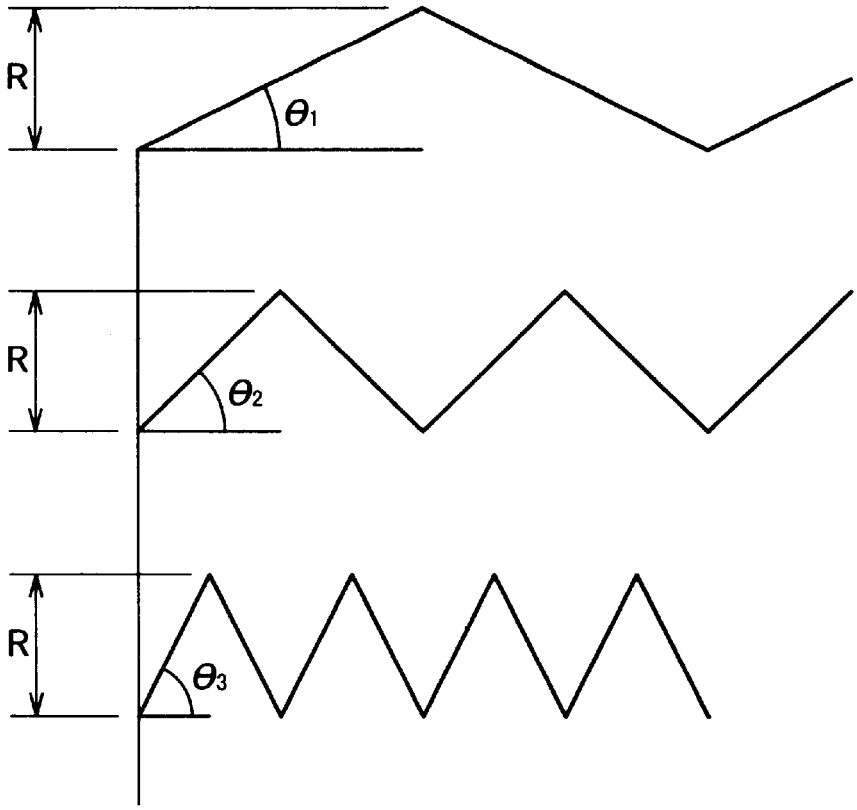
FIG. 7B
FIG. 7C
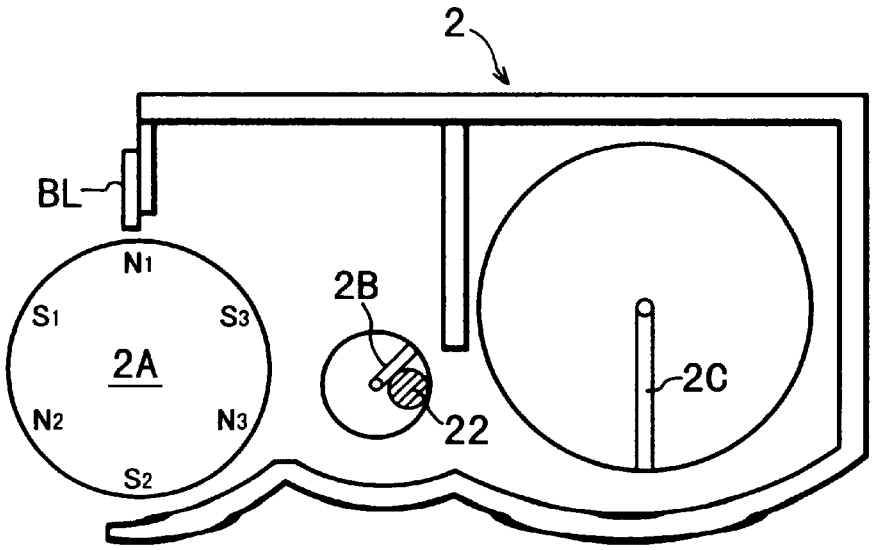
FIG. 8

DEVELOPER-CARRYING MEMBER, AND DEVELOPING DEVICE AND IMAGE FORMING APPARATUS INCLUDING THE MEMBER

FIELD OF THE INVENTION AND RELATED ART

The present invention relates to a developer-carrying member, a developing device and an image forming apparatus used for electrophotographic copying machines, laser beam printers, facsimile apparatus, printing apparatus, etc.

Conventional developer-carrying members are provided with roughened uneven surfaces for conveying a developer. As old proposals, Japanese Laid-Open Patent Application (JP-A) 54-79043 disclosed are provided with knurls principally for a two-component developer system and JP-A 55-26526 proposed one provided with a roughened surface principally for a mono-component developer system.

As a material for such a surface-roughness developer-carrying member, it has been proposed to use a relatively hard material for forming a surface-coating layer on a substrate. For example, JP-A 58-132768 has disclosed a developer-carrying member comprising an aluminum substrate surface-coated with a nitride such as TiN or CrN, a carbide such as TiC or $B_4C$, or an Ni—P plating layer; JP-A 6-230676 has disclosed a developer-carrying member comprising a substrate of aluminum, brass, stainless steel, etc., surface-coated with Cr plating, an anodized aluminum film, Ni—P plating or nitriding layer; and JP-A 3-41485 has disclosed a developer-carrying member comprising a substrate of aluminum, stainless steel, etc., surface-coated with a plating layer of Cr, Cu—Cr, Ni—Cr, Cu—Ni—Cr or Ni—Cu—Ni—Cr.

The above-mentioned wear-resistant surface-coating layers include an electroless Ni—P plating layer which can provide such a highly wear-resistant plating layer as to show a high Vickers hardness of 900 or higher after being heat-treated at 300–500° C. (JP-A 58-132768). Such a heat treatment can substantially lower the product yield. This is because the substrate can cause a thermal deformation on the order of several tens of $\mu$m in a direction perpendicular to its longitudinal direction as a result of the heat treatment, so that the spacing between the electrostatic image-bearing member and the developer-carrying member fluctuates locally, thereby causing local toner image irregularity. Such an image irregularity poses a serious obstacle for providing high-quality toner images.

Electroplating provides a hard surface-coating layer exhibiting an excellent wear resistance without requiring a high-temperature heat treatment as in a post-treatment of the electroless Ni—P plating layer.

However, the use of an electroplating layer is accompanied with a problem for the purpose of providing a surface-coating layer having a prescribed desirable surface shape. More specifically, the developer-carrying member is generally required to have a surface exhibiting a prescribed degree of surface roughness in order to exhibit good developer-conveying performance, provide an appropriate level of charge to the developer by friction with the developer and prevent the developer sticking. It is difficult to provide an electroplating layer with such a prescribed surface roughness. This is for the following reason.

In the electroplating, metal is deposited from a plating liquid on a substrate in an amount proportional to a density of electric lines of force directed toward the substrate.

However, the substrate surface is generally accompanied with minute projections and cracks, and the electric lines of force tend to concentrate onto peaks of the projections or edges of the cracks. As a result, the metal is abnormally or excessively deposited at these sites, thus failing to provide an electroplating layer with prescribed surface roughness.

SUMMARY OF THE INVENTION

Accordingly, an object of the present invention is to provide a developer-carrying member coated with an electroplating layer having a high accuracy of surface roughness and free from abnormal local metal deposition sites.

Further objects of the present invention are to provide a developing device and an image forming apparatus including such a developer-carrying member.

According to the present invention, there is provided a developer-carrying member for carrying and conveying a developer along a surface thereof, comprising a substrate, and an intermediate electroless plating layer and an electroplating layer disposed in this order on the substrate.

The present invention further provides:

a developing device, comprising the above-mentioned developer-carrying member for carrying and conveying a developer along a surface thereof, disposed opposite to an electrostatic image-bearing member bearing an electrostatic image thereon; and an image forming apparatus, comprising: an electrostatic image-bearing member for bearing an electrostatic image on a surface thereof, and a developing device for developing the electrostatic image comprising the above-mentioned developer-carrying member disposed opposite to the electrostatic image-bearing member.

In the developer-carrying member according to the present invention, an electroless plating layer is disposed as an intermediate layer between a substrate and an electroplating layer, whereby the electroplating layer exhibiting a high hardness can be formed with a high accuracy of surface roughness free from abnormal metal deposition sites. More specifically, in the electroless plating, a metal is deposited on the substrate by a chemical reaction, so that the metal deposition is not concentratively caused at minute projections or along edges of cracks present on the substrate surface. As a result, the shapes of such projections and cracks on the substrate surface are not copied or reflected on the surface of the intermediate electroless plating layer surface, so that the electroplating layer thereon are free from adverse influences of the projections and cracks on the substrate surface.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 7A–7C roughly illustrate three variations of average slope Δa=tan θ.

FIG. 8 is a sectional illustration of an embodiment of the developing device according to the invention.

PREFERRED EMBODIMENTS OF THE INVENTION

Figure 1:
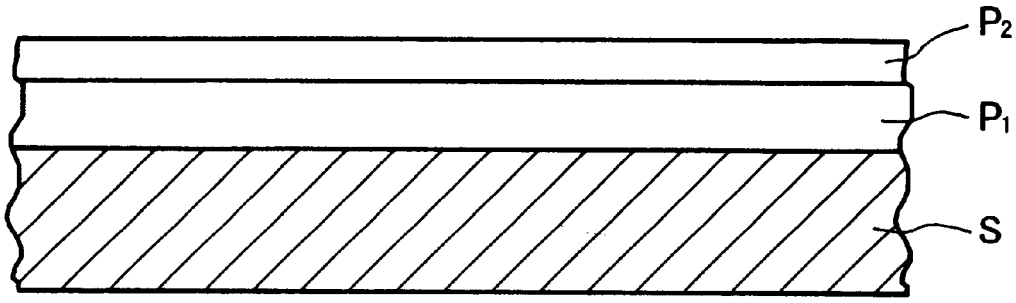
FIG. 1 is a schematic partial sectional view of an embodiment of the developer-carrying member according to the invention.

FIG. 1 is a schematic partial sectional view of a developer-carrying member according to the present invention. Referring to FIG. 1, the developer-carrying member basically comprises a substrate S, an intermediate electroless plating layer P1 and an electroplating layer P2 in this order.

Figure 2:
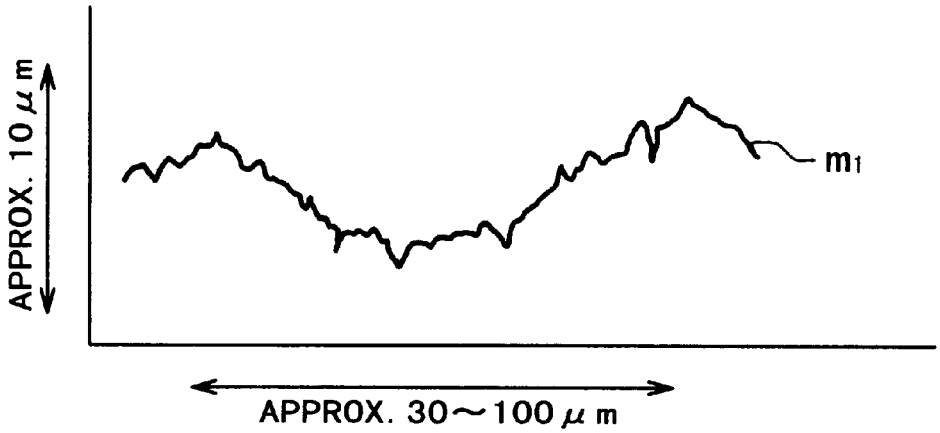
FIG. 2 is a graphic representation of a roughened surface of a substrate.
Figure 3:
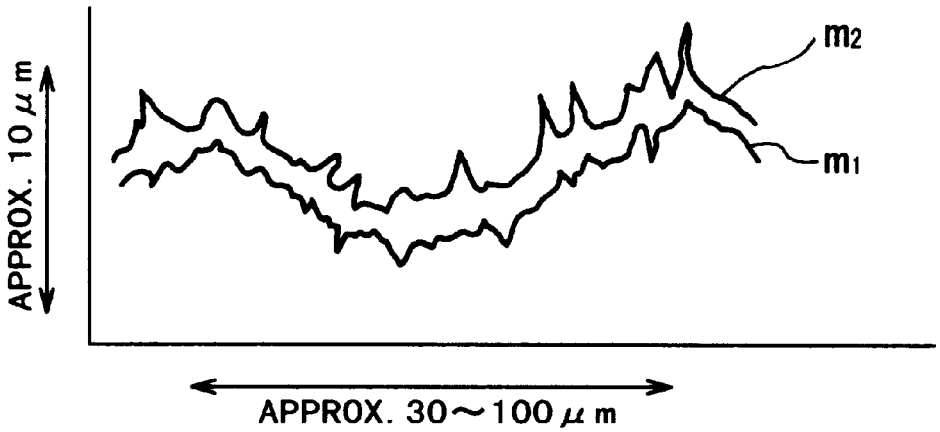
FIG. 3 is a graphic representation of a roughened and electroplated surface of a substrate.

FIG. 2 shows a surface roughness curve m1 representing a roughness of an aluminum cylindrical substrate provided with surface unevenness by blasting. The curve shows major roughnesses and also a large number of minute projections and cracks. When such a substrate surface is coated with an electroplating layer, the resultant electroplating layer surface is provided with steep projections and cracks as represented by a curve m2 in FIG. 3 emphatically affected by the minute surface projections and cracks on the substrate surface. An electroplating surface layer facing such a surface shape can only show an inferior charge-imparting function to the developer, and the developer is liable to fall in and stick to the steep concavities, thus causing developer soiling of the developer-carrying member.

Figure 4:
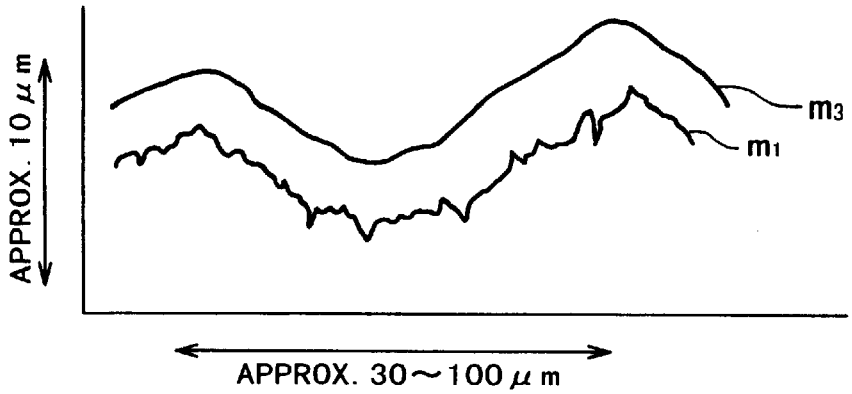
FIG. 4 is a graphic representation of a roughened and electroless-plated surface of a substrate.

FIG. 4 shows a surface roughness curve m3 representing a surface-roughness of an electroless plating layer formed on a surface-roughened substrate. As a characteristic of the electroless plating, the resultant roughness curve m3 is rather smooth and not substantially affected by minute projections and cracks on the substrate surface.

Figure 5:
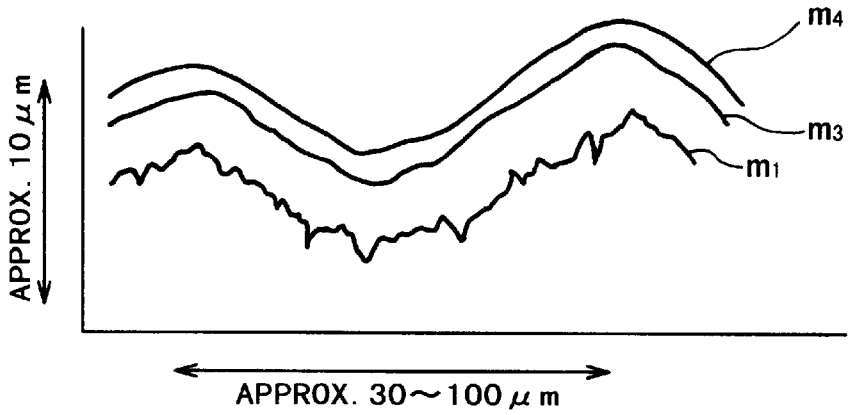
FIG. 5 is a graphic representation of a roughened, electroless-plated and electroplated surface of a substrate.

FIG. 5 shows a surface-roughness curve m4 representing a surface roughness of an electroplating layer formed on the electroless plating layer of which the surface roughness is represented by the curve m3 in FIG. 4 (and also in FIG. 5). As represented by the curve m4, the electroplating layer is provided with a smooth surface because of the smooth surface shape of the intermediate electroless plating layer disposed therebelow, so that the problems involved in a developer-carrying member having a rough surface as represented by the curve m2 in FIG. 3 can be completely obviated.

Now, a suitable organization of the developer-carrying member according to the present invention will be described.

The substrate may have a shape of a cylindrical tube (sleeve), cylindrical bar or a flat plate which basically determines the shape of a developer-carrying member suitably incorporated in an objective developing device.

The developer-carrying member may desirably have an appropriate level of surface roughness as represented by a ten-point average roughness Rz of 0.3– 7 μm or an arithmetic average roughness Ra of 0.05–1.1 μm, respectively measured according to JIS B0601. This may possibly be accomplished by surface-roughening the electroplating layer forming a surface layer of the developer-carrying member according to the present invention, but this is accompanied with a risk of peeling of the plating layer or attachment of blasting abrasive particles. Accordingly, it is preferred to preliminarily subject the substrate surface to a roughening treatment to provide a surface roughness Rz of ca. 1–8 μm or Ra of 0.1–1.2 μm. The surface roughening may suitably be performed by blasting with spherical particles.

Preferred examples of the substrate material may include: aluminum, aluminum alloys and copper alloys. These materials are non-magnetic and are suitable for a development scheme utilizing a magnetic field. These are also relatively soft metals as represented by a Vicker's hardness of 40–180, so that a surface-roughening treatment can be easily applied. They also have a high thermal conductivity of 150 W/m.K or higher, so that heat accumulation and thermal expansion leading to a lowering in size accuracy are less liable to occur.

The intermediate electroless plating layer may preferably have a thickness of at least 3 μm so as to effectively cover minute projections and cracks on the substrate surface, and suitably at most 30 μm so as to form a uniform plating layer and so as to develop a prescribed degree of unevenness contributing to toner-carrying performance of the substrate surface on the plating layer surface.

The electroless plating layer may suitably be formed of a material, such as Ni—P, Ni—B (preferably containing 5–7 wt. % of B), Pd—P, Ni—Co—P, Ni—Fe—P, Ni—W—P, Ni—Cu—P, Co—P, Cu, Sn or Au. Ni—P (containing preferably 5–15 wt. % of P) is particularly preferred in view of wide industrial applicability and stable quality of the resultant film.

The electroplating layer may suitably have a Vicker's hardness Hv of at least 300, preferably at least 500 in view of wear resistance. The electroplating layer may suitably comprise Cr, Ni, Pt or Ph (rhodium), and Cr giving a Hv of 600 or higher is particularly preferred.

The electroplating layer may preferably have a thickness of at least 0.2 μm in view of durability and suitably at most 5 μm which is not excessively thick so as to provide a good surface property. Further, so as to develop the smooth surface shape of the electroless plating layer therebelow, the electroplating layer may preferably have a thickness which is smaller than that o the electroless plating layer, particularly 1/10 or less of the thickness of the electroless plating layer.

In order to enhance the adhesion between the electroless plating layer and the electroplating layer, it is also effective to dispose an intermediate adhesion layer, as desired, between these plating layers. An Ni plating layer (preferably an Ni electroplating layer) is particularly effective as such an intermediate adhesion layer in the case where the electroless plating layer is Ni—P plating layer and the electroplating layer is a Cr plating layer.

The developer-carrying member is required to be free from so-called sleeve soiling caused by attachment of the developer even after a long period of use. From the view of preventing the sleeve soiling, the developer-carrying member surface may preferably show an average slope Δa of at most 0.12. On the other hand, the average slope Δa may preferably be set to at least 0.01 in view of the developer-carrying performance.

Figure 6:
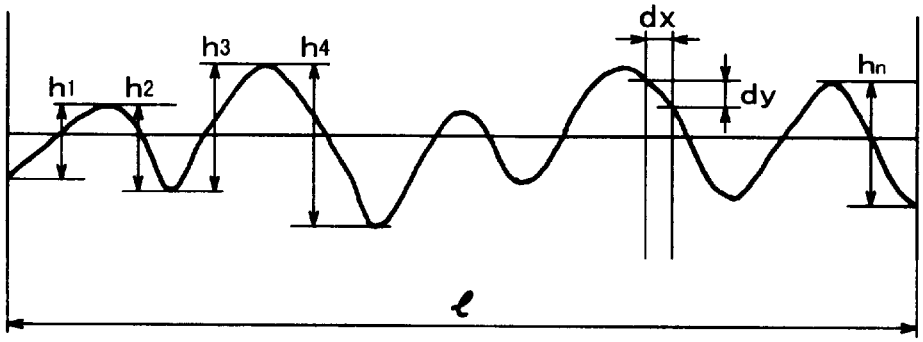
FIG. 6 is a graphic illustration as a how an average slope Δa of a developer-carrying member surface is determined.

The average slope Δa may be determined based on a surface roughness curve as shown in FIG. 6 and according to the following formula:

$$\Delta a = \frac{1}{l}\int_0^l \left|\frac{dy}{dx}\right| dx = \left(\frac{h1 + h2 + h3 + \ldots + hn}{l}\right)$$

wherein h1, h2, h3 . . . hn are peak-valley distances along a center line of the surface roughness curve for a standard length 1. The average slope a may roughly be given as a representative slope Δa=tan θ of each surface roughness curve as illustrated in FIGS. 7A–7C for three cases, wherein R represents a height of a representative peak.

The sleeve soiling level has a correlation with an average slope Δa of a developer-carrying member surface, and a smaller Δa leads to a lower degree of soiling. In other words, the soiling on the developer-carrying member surface depends on the surface shape rather than the level of surface roughness as represented by Ra or Rz of the developer-carrying member.

The values Δa, Ra and Rz described herein are based on values measured by using a contact-type surface roughness meter ("SURFCODER SE-3300", available from K.K. Kosaka Kenkusho) under conditions of a cut-off value of 0.8 mm, a measurement length of 2.5 mm, a feed speed of 0.1 mm/s, and a magnification of 5000. One measurement by the meter provides three values of Δa, Ra and Rz simultaneously.

An embodiment of the developing device according to the present invention is illustrated in FIG. 8. Referring to FIG. 8, a developing device 2 includes a developing sleeve 2A (developer-carrying member) which has been obtained by blasting a 30 mm-dia. cylindrical tube of aluminum alloy (A6063 according to JIS) with spherical glass particles of 600 mesh-pass (FGB#600) to provide a surface roughness Rz of 3.0 μm and then subjecting the cylinder to two steps of plating for providing a laminate structure as shown in FIG. 1. Within the developing sleeve 2A, a fixed magnet having magnetic poles and a magnetic field pattern as shown in Table 1 below is disposed. A toner (as a developer) is applied on the developing sleeve 2A in a thickness controlled by a magnetic blade BL which is placed apart from the sleeve 2A with a gap of, e.g., 250 μm. The developing device 2 is further equipped with a first stirring bar 2B and a second stirring bar 2C for stirring the toner, and a toner amount detection sensor (piezoelectric device) 22.

TABLE 1

| Pole | Magnetic force (G) | Angle (deg.) |
|---|---|---|
| N1 | 1000 | 0 |
| N2 | 1000 | 120 |
| N3 | 600 | 220 |
| S1 | 900 | 60 |
| S2 | 500 | 175 |
| S3 | 700 | 270 |

Figure 9:
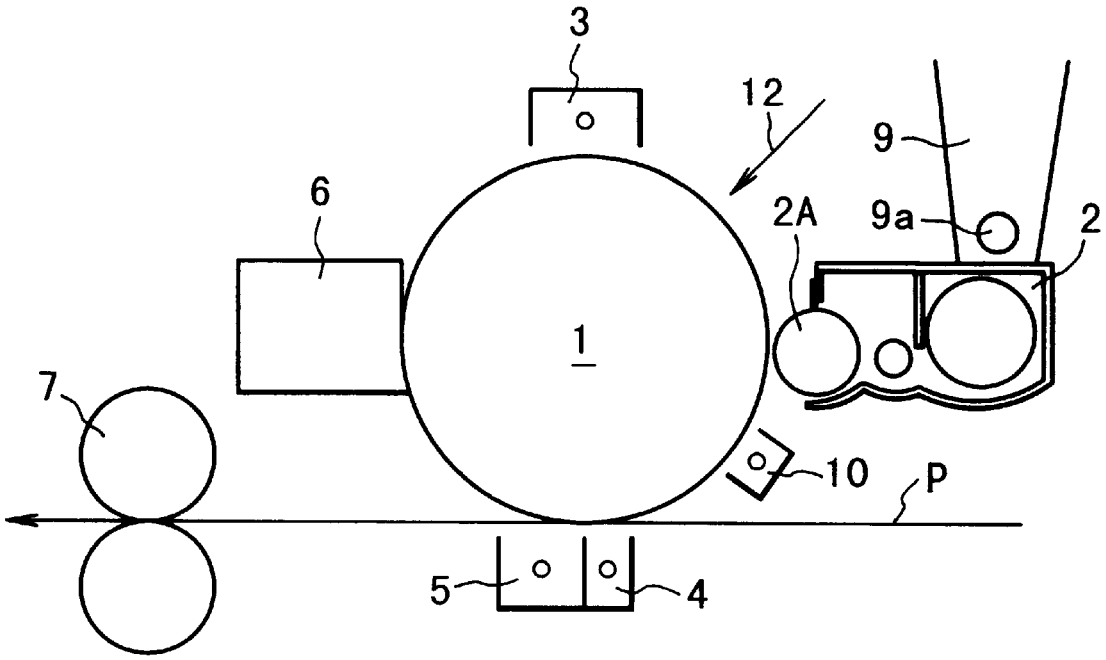
FIG. 9 is a sectional illustration of an embodiment of the image forming apparatus according to the invention.

FIG. 9 illustrates an embodiment of the image forming apparatus according to the invention.

Referring to FIG. 9, the image forming apparatus includes an a-Si (amorphous-silicon) photosensitive drum 1 of 108 mm in diameter, which is rotated at a process speed of 300 mm/sec for providing monochromatic copies of 60 A4-size sheets/min. An a-Si photoconductor has a dielectric constant of ca. 10 larger than an organic photoconductor (OPC) and a relatively low potential so that it is difficult to attain a sufficient latent image potential. On the other hand, an a-Si photosensitive member has a high durability providing a life of more than $3\times10^6$ sheets, so that it is suited for a high-speed image forming machine.

In this embodiment, the photosensitive member 1 is uniformly charged to, e.g., +400 volts and exposed to image light 12 at a resolution of 600 dpi. The image light 12 having a wavelength of, e.g., 680 nm is emitted from a semiconductor laser as a light source and illuminates the photosensitive member to lower the surface potential at an exposed part to +50 volts, thereby forming a latent image on the photosensitive member.

More specifically, laser light emitted from the laser is processed through an optical system including a collimator lens, a polygonal scanner, an f-θ lens, a reflecting mirror and a dust-protection glass to provide the image light 12 which is then caused to illuminate the photosensitive drum 1 in a focused spot size on the drum which is a little larger than 42.3 μm that is one pixel size corresponding to the resolution of 600 dpi, whereby an electrostatic latent image having an exposed part potential of ca. +50 volts is formed on the drum 1. The electrostatic latent image is then developed with the toner from the developing device 2 to form a toner image on the drum 1. The toner image is then positively charged with a total current of ca. +100 μA (AC+DC) from a post charger 10 so as to weaken the adhesion between the photosensitive member and the toner and facilitate the transfer and separation of the toner image from the drum 1. In this embodiment, the development is performed by using a black magnetic mono-component developer which allows a simple and highly durable developing system not requiring a maintenance until the end of the developing sleeve life. The toner used as a positively chargeable toner having a weight-average particle size of 8.0 μm. When the toner in the vicinity of the sensor 22 is absent due to continual use, the detector 22 detects the absence to output a piezoelectric signal for rotating a magnet roller 9*a* thereby replenishing a fresh toner from a hopper 9 into the developing device 2. The toner image formed on the drum 1 and having passed by the post charger 10 is then transferred onto a transfer material P moved in an indicated arrow direction under the action of a transfer charger 4 and a separation charger 5. The toner image on the transfer material P is then sent to a fixing device 7 where the toner image is fixed. A portion of the toner remaining on the drum 1 after the transfer is removed from the drum 1 by a cleaner 6.

Figure 10:
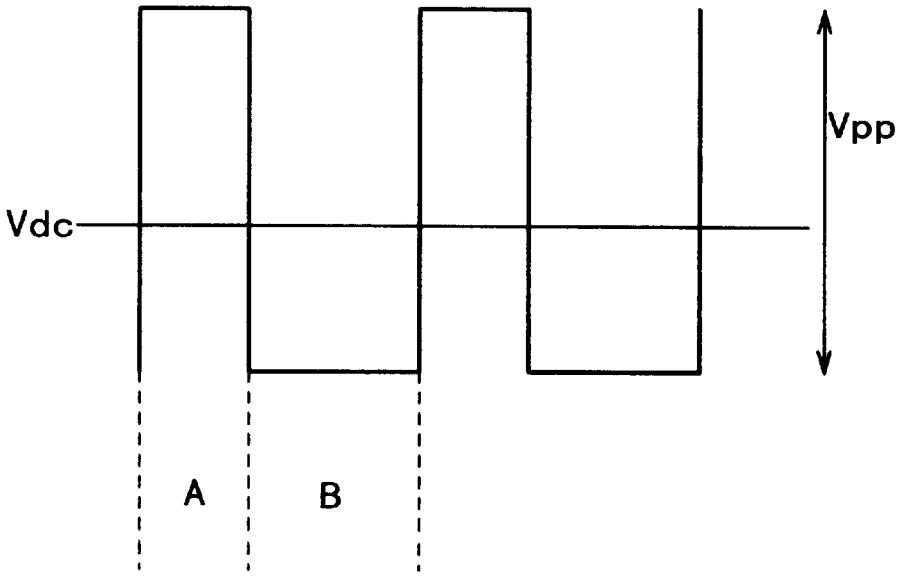
FIG. 10 illustrates an AC/DC superposed bias voltage applied to a developing sleeve (developer-carrying member) used in an Example.

In the case of using an a-Si drum 1 as an electrostatic image-bearing member suitable for a high-speed image forming machine, a drum heater is generally installed with the drum 1 so as to prevent the occurrence of image flow at the time of start-up and retain a stable performance while obviating adverse effect of a temperature-dependence of the a-Si photoconductor. If the developing sleeve comprising stainless steel is used in combination with a drum equipped with a drum heater, the developing sleeve is liable to cause a thermal deformation due to a heat from the drum heater and a small thermal conductivity of the stainless steel. For this reason, the developing sleeve may preferably comprise a material, such as aluminum or aluminum alloy, having a large thermal conductivity and less liable to cause a thermal deformation due a heat from the drum heater. The developing sleeve 2A rotates at a peripheral speed which is, e.g., 150% of that of the photosensitive drum 1 with a gap of, e.g., 220 μm, from the photosensitive drum 1. The development is performed under application of a developing bias voltage to the developing sleeve 2A. An example of the developing bias voltage suitably applied to the developing sleeve 2A is an AC/DC superposed voltage as shown in FIG. 10 which comprises an AC voltage having a peak-to-peak voltage (Vpp) of 1.3 kV, a frequency of 2.7 kHz and a duty ratio (=A/(A+B)) of 35% superposed with a DC voltage (Vdc) of 280 volts for effecting a non-contact development scheme using a non-magnetic mono-component developer. The voltage component A functions to drive the toner toward the drum 1, and the voltage component B functions to drive the toner back to the developing sleeve 2A. As a result, the developing contrast is 230 volts (=280 volts−50 volts) toward the developing direction (toward the drum), and the fog-removing contrast (toward the sleeve) is 120 volts (=400−280 volts).

An example of magnetic toner suitably used in this embodiment is a magnetic toner comprising magnetic toner particles each containing magnetic fine particles dispersed in a resin.

The toner may have a volume-average particle size of 4–10 μm, preferably 6–8 μm. Below 4 μm, the toner control becomes difficult, and particularly the solid black image portion is liable to exhibit a lower density. Above 10 μm, the resolution of thin line image is liable to be inferior. In a specific example, a toner having a volume-average particle size of 7 μm was used.

Particle size distribution of toner particles may be measured according to various methods.

The values described herein are based on measurement using a Coulter Counter TA-II (available from Coulter Electronics, Inc.). For measurement, several mg of a sample toner is dispersed in an electrolytic solution formed by adding several drops of a surfactant to a 1%-NaCl aqueous solution, and subjecting the mixture to ultrasonic dispersion for several minutes. The resultant sample dispersion is subjected to a particle size distribution measurement in a particle size range of 2–40 μm through an aperture of 100 μm. For the specific toner having a volume-average particle size of 7 μm, a fine powder fraction of 4 μm or smaller was suppressed to 20% or less by number, and a coarse powder fraction of 15 μm or a larger was suppressed to 5% or less by volume.

The toner binder may generally comprise a styrene-based polymer, such as a styrene-acrylate copolymer or a styrene-butadiene copolymer, a phenolic resin or a polyester resin. In a specific example, a 8:2 (by weight) mixture of a styrene-acrylate copolymer and a styrene-butadiene copolymer was used.

A charge-control agent may generally be added internally to the toner particles but can also be externally blended with the toner particles. Suitable examples thereof for providing positively chargeable toners may include: nigrosine, quaternary ammonium compounds, triphenylmethane compounds and imidazole compounds. In a specific example, a triphenylmethane compound was added in an amount of 2 wt. parts per 100 wt. parts of the binder resin.

Further, paraffin wax was added as a wax component and magnetite particles were added as magnetic particles to provide toner particles, to which silica was externally added to provide a positively chargeable toner.

Next, several examples for production of developing sleeves are described.

PRODUCTION EXAMPLE 1

(Blasting)

An Al sleeve of 32 mm in outer diameter and 0.65 mm in thickness was subjected to surface-blasting with 600 mesh-spherical glass beads in the following manner.

More specifically, against the sleeve rotating at 36 rpm, the glass beads were blown through 4 nozzles of each 7 mm in diameter and disposed at a distance of 150 mm in 4 directions around the sleeve at a blasting pressure of 2.5 kg/cm$^2$ for 9 sec. (totally: 36 sec). After the blasting, the blasted sleeve surface was washed and dried to have surface roughnesses Ra of 0.6 μm and Rz of 4 μm.

(Plating pre-treatment)

The blasted Al sleeve was treated with a commercially available zincate agent ("SUMER K-102", available from Nippon Kanizen K.K.) to surface-deposit zinc thereon for improving the adhesion of a N—P plating layer to be formed on the Al sleeve surface.

(Ni—P plating)

The above-treated Al sleeve was dipped in a commercially available Ni—P electroless plating liquid ("S-754", available from Nippon Kamizen K.K.) for 100 min. of electroless plating at 90° C., thereby forming a 19 μm-thick Ni—P (P content=10.3 wt. %) electroless plating layer.

The thus Ni—P-plated sleeve exhibited a hardness Hv of 501–524, surfaces roughness Ra of 0.5 μm and Rz of 3.5 μm, a coercive force of substantially zero (oersted) and a saturation magnetic flux on the order of 5 Gauss, so that the sleeve inclusive of the Ni—P layer could be regarded as non-magnetic as a whole.

(Ni plating)

The above Ni—P-plated sleeve was dippsed in a Ni-plating liquid (sulfuric acid-acidified nickel sulfate aqueous solution) for 60 sec. of electroplating at 25° C. under a current density of 4 A/dm$^2$ and 2 volts to form a 0.3 μm-thick Ni-plating layer.

(Cr plating)

The Ni-plated sleeve was then dipped in a commercially available Cr plating liquid (aqueous chromatic acid solution) for 15 min. of electroplating at 45° C. and a current density of 15 A/dm$^2$ to form a 1 μm-thick Cr-plating layer.

The thus Cr-plated sleeve exhibited a coercive force of 94 oersted and a saturation magnetic flux of 145 Gauss, thus exhibiting ferromagnetism.

Further, the Cr-plated sleeve exhibited a hardness Hv of 605–640, surface roughnesses Ra of 0.53 μm and Rz of 3.54 μm, and an average slope Δa of 0.08.

(Magnet insertion)

A magnet characterized by the data shown in the above Table 1 was inserted in the above-treated sleeve to provide Developing sleeve 1.

PRODUCTION EXAMPLE 2

An identical Al sleeve as used in Production Example was subjected to the following treatments to prepare Developing sleeve 2.

(Blasting)

Blasting was performed in the same manner as in Production Example 1 except for using 400 mesh-spherical glass beads instead of the 600 mesh-glass beads. The blasted sleeve exhibited Ra=0.8 μm and Rz=5 μm.

(Plating-pretreatment)

Performed similarly as in Production

EXAMPLE 1

(Ni—B plating)

The above-treated Al sleeve was dipped in an Ni—B electroless plating liquid (a weakly acidic solution of nickel sulfate, dimethylamineborane and sodium malonate) for electroless plating to form a 17 μm-thick Ni—B (B content=60 wt. %) plating layer.

The thus Ni—B-plated Al sleeve exhibited Hv=550–700, Ra=0.6 μm, Rz=4 μm, a coercive force=90 oersted, and a saturation magnetic flux=350 Gauss, thus exhibiting magnetism as a whole.

(Ni plating)

The Ni—B-plated sleeve was subjected to Ni-plating in the same manner as in Production Example 1.

(Cr plating)

The Ni-plated sleeve was subjected to Cr plating in the same manner as in Production Example 1. The Cr-plated sleeve exhibited a coercive force=83 oersted and a saturation magnetic flux=5850 Gauss, thus exhibiting ferromagnetism as a whole.

The Cr-plated sleeve also showed Hv=605– 640, Ra=0.7 μm, Rz=4.3 μm and Δa=0.08.

(magnet insertion)

Developing sleeve 2 was completed by inserting an identical magnet as in Production Example 1 into the above-treated sleeve.

PRODUCTION EXAMPLE 3

An identical Al sleeve as used in Production Example 1 was subjected to the following treatments to prepare Developing sleeve 3.

(Blasting)

Blasting was performed in the same manner as in Production Example 1 except for using 800 mesh-spherical glass beads instead of the 600 mesh-glass beads. The blasted sleeve exhibited Ra=0.55 μm and Rz=5 μm.

(Plating-pretreatment)

Performed similarly as in Production Example 1.

(Ni—P plating)

The above-treated Al sleeve was dipped in an Ni—P electroless plating liquid to effect electroless plating in a similar manner as in Production Example 1 to form a 15 μm-thick Ni—P (P content=10.3 wt. %) plating layer.

The thus Ni—P-plated Al sleeve exhibited Hv=501–524, Ra=0.5 μm, Rz=3.5 μm, a coercive force=ca. 0 oersted, and a saturation magnetic flux=ca. 5 Gauss, thus exhibiting substantially no magnetism as a whole.

(Ni plating)

The Ni—P-plated sleeve was subjected to Ni-plating in the same manner as in Production Example 1 to form a 1 μm-thick Ni plating layer.

The Ni-plated sleeve exhibited a coercive force=100 oersted and a saturation magnetic flux=2000 Gauss, thus exhibiting ferromagnetism as a whole.

The Ni-plated sleeve also showed Hv=500–550, Ra=0.5 μm, Rz=2.7 μm and Δa=0.06.

(magnet insertion)

Developing sleeve 3 was completed by inserting an identical magnet as in Production Example 1 into the above-treated sleeve.

COMPARATIVE PRODUCTION EXAMPLE 1

Comparative Developing sleeve 1 having only an Ni—P plating layer was prepared in the same manner as in Production Example 1 except for omitting the steps of Ni plating and Cr plating in the process of Production Example 1.

COMPARATIVE PRODUCTION EXAMPLE 2

Comparative Developing sleeve 2 was prepared in the same manner as in Production Example 1 except for omitting the steps of Ni—P plating and Ni plating and performing the step of Cr plating for forming a 1μ-thick Cr electroplating Cr layer directly on the pretreated Al sleeve.

COMPARATIVE PRODUCTION EXAMPLE 3

Comparative Developing sleeve 3 was prepared in the same manner as in Production Example 1 except for omitting the steps of Ni—P plating and Cr plating and performing the step of Ni plating for forming only a 1.5 μm-thick Ni electroplating layer directly on the pretreated Al sleeve.

<Performance evaluation>

Each of the above-prepared developing sleeves was installed in a developing device as shown in FIG. 8 and the developing device was incorporated in an image forming apparatus as shown in FIG. 9 to effect a continuous printing test on $10^6$ sheets. The degree of wearing of the developing sleeve was evaluated in terms of surface roughnesses before and after the continuous printing test. The results are inclusively shown in the following Table 2.

TABLE 2

| Developing sleeve | Surface roughness | Before printing | After printing |
|---|---|---|---|
| 1 | Ra | 0.53 | 0.50 |
| | Rz | 3.54 | 3.44 |
| 2 | Ra | 0.70 | 0.66 |
| | Rz | 4.30 | 4.00 |
| 3 | Ra | 0.50 | 0.40 |
| | Rz | 2.70 | 2.50 |
| Comp. 1 | Ra | 0.50 | 0.16 |
| | Rz | 3.50 | 1.20 |
| Comp. 2 | Ra | 0.60 | 0.58 |
| | Rz | 3.84 | 3.72 |
| Comp. 3 | Ra | 0.57 | 0.15 |
| | Rz | 3.64 | 1.05 |

As is understood from the results shown in Table 2, Developing sleeves 1–3 according to the present invention showed substantially no wearing but retained the initial surface roughnesses even after the continuous printing test. In contrast thereto, Comparative Developing sleeves 1 and 3 showed severe degree of wearing after the continuous printing test.

The results of the image forming performances in the continuous printing test are inclusively shown in the following Table 3 together with some characterization of the respective developing sleeves.

TABLE 3

| Developing sleeve | Sleeve structure: Plating layer *1: First (surface) | Second (below surface) | Substrate | Evaluation *2: Image density | Image quality |
|---|---|---|---|---|---|
| 1 | E. Cr | EL. Ni-P | Al tube | A | A |
| 2 | E. Cr | EL. Ni-B | Al tube | A | A |
| 3 | E. Ni | EL. Ni-P | Al tube | A | A |
| Comp. 1 | EL. Ni-P | none | Al tube | B | BC |
| Comp. 2 | E. Cr | none | Al tube | C | C |
| Comp. 3 | E. Ni | none | Al tube | C | C |

*1: E. denotes an electroplating layer. EL. denotes an electroless plating layer.

*2 The evaluation was performed with respect to images formed in the final stage of the continuous printing test.

images formed in the final stage of the continuous printing test.

(Image density)

Evaluated based on the image density value ID of said black image parts measured by using a Macbeth densitometer (available from Macbeth Co.) according to the following standard.

A: ID≧1.3

B: 1.1≦ID<1.3

C: ID<1.1

(Image quality)

Evaluated with eyes according to the following standard.

A: Good character reproducibility.

B: Somewhat inferior but practically acceptable level of character reproducibility.

C: Inferior character reproducibility.

BC: Intermediate level between B and C.

As shown in Table 3, Developing sleeves 1–3 according to the present invention provided high-quality printed images over a long period. On the other hand, Comparative Developing sleeve 2 exhibited inferior image qualities while it exhibited a good wear resistance as shown in Table 2.

What is claimed is:

1. A developer-carrying member for carrying and conveying a developer along a surface thereof, comprising a substrate, and an intermediate electroless plating layer and an electroplating layer disposed in this order on the substrate.

2. A developer-carrying member according to claim 1, wherein the substrate has a ten point-average surface roughness Rz of 1–8 μm or an arithmetic average surface roughness Ra of 0.1–1.2 μm.

3. A developer-carrying member according to claim 1, wherein the substrate comprises aluminum, aluminum alloy or copper alloy, and has a Vickers hardness Hv of 40–180.

4. A developer-carrying member according to claim 1, wherein the intermediate electroless plating layer has a thickness of 3–30 μm.

5. A developer-carrying member according to claim 1, wherein the intermediate electroless plating layer comprises an Ni—P plating layer.

6. A developer-carrying member according to claim 1, wherein the electroplating layer has a thickness of 0.2–5 μm.

7. A developer-carrying member according to claim 1, wherein the electroplating layer has a thickness smaller than that of the electroless plating layer.

8. A developer-carrying member according to claim 1, which has a surface exhibiting an average slope Δa of 0.01–0.12.

9. A developer-carrying member according to claim 1, wherein the electroplating layer comprises a Cr plating layer.

10. A developer-carrying member according to claim 1, wherein the intermediate electroless plating layer comprises an Ni—P plating layer, and the electroplating layer comprises a Cr plating layer.

11. A developer-carrying member according to claim 1, wherein the intermediate electroless plating layer has a thickness of 3–30 μm, and the electroplating layer has a thickness that is in the range of 0.2–5 μm and is smaller than that of the intermediate electroless plating layer.

12. A developer-carrying member according to claim 1, further including an Ni plating layer between the intermediate electroless plating layer and the electroplating layer.

13. A developing device, comprising: a developer-carrying member for carrying and conveying a developer along a surface thereof, disposed opposite to an electrostatic image-bearing member bearing an electrostatic image thereon; wherein the developer-carrying member comprises a substrate, and an intermediate electroless plating layer and an electroplating layer disposed in this order on the substrate.

14. A developing device according to claim 13, wherein the substrate of the developer-carrying member is in the form of a cylindrical tube, in which a magnetic field-generating means is installed.

15. A developing device according to claim 13, wherein the intermediate electroless plating layer of the developer-carrying member comprises an Ni—P plating layer.

16. A developing device according to claim 13, wherein the electroplating layer of the developer-carrying member comprises a Cr plating layer.

17. A developing device according to claim 13, wherein the electroless plating layer and the electroplating layer of the developer-carrying member comprise an Ni—P plating layer and a Cr plating layer, respectively.

18. A developing device according to claim 13, wherein the developer-carrying member further includes an Ni plating layer between the intermediate electroless plating layer and the electroplating layer.

19. An image forming apparatus, comprising: an electrostatic image-bearing member for bearing an electrostatic image on a surface thereof, and developing device for developing the electrostatic image comprising a developer-carrying member disposed opposite to the electrostatic image-bearing member; wherein the developer-carrying member comprises a substrate, and an intermediate electroless plating layer and an electroplating layer disposed in this order on the substrate.

20. An image forming apparatus according to claim 19, wherein the substrate of the developer-carrying member is in the form of a cylindrical tube, in which a magnetic field-generating means is installed.

21. An image forming apparatus according to claim 19, wherein the developer comprises a toner having a volume-average particle size of 4–10 μm.

22. An image forming apparatus according to claim 19, wherein the developer comprises a positively chargeable toner.

23. An image forming apparatus according to claim 19, wherein the electrostatic image-bearing member comprises a drum of amorphous silicon, in which an internal heater is installed.

24. An image forming apparatus according to claim 19, wherein the electroplating layer of the developer-carrying member comprises a Cr plating layer.

25. An image forming apparatus according to claim 19, wherein the electroless plating layer and the electroplating layer of the developer-carrying member comprise an Ni—P plating layer and a Cr plating layer, respectively.

26. An image forming apparatus according to claim 25, wherein the developer-carrying member further includes an Ni plating layer between the intermediate electroless plating layer and the electroplating layer.

* * * * *

UNITED STATES PATENT AND TRADEMARK OFFICE

CERTIFICATE OF CORRECTION

PATENT NO. : 6,201,942 B1
DATED : March 13, 2001
INVENTOR(S) : Takao Honda et al.

It is certified that error appears in the above-identified patent and that said Letters Patent is hereby corrected as shown below:

Column 3,
Line 1, "as a" should read -- as to --.

Column 4,
Line 44, "that o" should read -- that of --.

Column 6,
Line 57, "due a" should read -- due to --.

Column 8,
Line 14, "surfaces" should read -- surface --; and
Line 20, "dippsed" should read -- dipped --; and
Line 51, "Production" should read -- PRODUCTION EXAMPLE 1. --; and
Line 53, ""EXAMPLE 1" should be deleted.

Column 9,
Lines 9 and 43, "(magnet insertion)" should read -- (Magnet Insertion) --.
Line 60, "1 μ-thick" should read -- 1 μm thick --.

Column 10,
Lines 57-58 should be deleted.

Signed and Sealed this

Eighth Day of January, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,201,942 B1
DATED : March 13, 2001
INVENTOR(S) : Takao Honda et al.

It is certified that error appears in the above-identified patent and that said Letters Patent is hereby corrected as shown below:

Column 3,
Line 1, "as a" should read -- as to --.

Column 4,
Line 44, "that o" should read -- that of --.

Column 6,
Line 57, "due a" should read -- due to --.

Column 8,
Line 14, "surfaces" should read -- surface --; and
Line 20, "dippsed" should read -- dipped --; and
Line 51, "Production" should read -- PRODUCTION EXAMPLE 1. --; and
Line 53, ""EXAMPLE 1" should be deleted.

Column 9,
Lines 9 and 43, "(magnet insertion)" should read -- (Magnet Insertion) --.
Line 60, "1 μ-thick" should read -- 1 μm thick --.

Column 10,
Lines 57-58 should be deleted.

Signed and Sealed this

Nineteenth Day of February, 2002

*Attest:*

*Attesting Officer*

JAMES E. ROGAN
*Director of the United States Patent and Trademark Office*